US008075735B2

(12) United States Patent
Jarck

(10) Patent No.: US 8,075,735 B2
(45) Date of Patent: Dec. 13, 2011

(54) SYSTEM AND METHOD FOR THE SEPARATION OF BAST FIBERS

(75) Inventor: Walter Jarck, Clarkesville, GA (US)

(73) Assignee: Timtek, LLC, Clarkesville, GA (US)

( * ) Notice: Subject to any disclaimer, the term of this patent is extended or adjusted under 35 U.S.C. 154(b) by 319 days.

(21) Appl. No.: 12/331,220

(22) Filed: Dec. 9, 2008

(65) Prior Publication Data

US 2009/0145563 A1 Jun. 11, 2009

Related U.S. Application Data

(63) Continuation-in-part of application No. 11/162,747, filed on Sep. 21, 2005, now Pat. No. 7,537,031, and a continuation-in-part of application No. 11/162,748, filed on Sep. 21, 2005, now Pat. No. 7,537,669.

(60) Provisional application No. 60/612,075, filed on Sep. 22, 2004, provisional application No. 61/012,564, filed on Dec. 10, 2007.

(51) Int. Cl.
*D21B 1/04* (2006.01)

(52) U.S. Cl. ..... 162/27; 162/94; 162/98

(58) Field of Classification Search ..... 162/20, 162/94, 98, 27
See application file for complete search history.

(56) References Cited

U.S. PATENT DOCUMENTS

| | | | | |
|---|---|---|---|---|
| 306,476 | A * | 10/1884 | Fremerey | 162/20 |
| 442,735 | A * | 12/1890 | Stewart | 19/6 |
| 3,508,523 | A | 4/1970 | De Meerleer | |
| 3,870,665 | A | 3/1975 | Diehr et al. | |
| 3,891,738 | A | 6/1975 | Shen | |
| 4,232,067 | A | 11/1980 | Coleman | |
| 4,393,019 | A | 7/1983 | Geimer | |
| 4,517,147 | A | 5/1985 | Taylor et al. | |
| 4,605,467 | A | 8/1986 | Bottger | |
| 4,655,869 | A | 4/1987 | Tellman et al. | |
| 4,675,066 | A | 6/1987 | Honda | |
| 4,684,489 | A | 8/1987 | Walter | |
| 4,695,345 | A | 9/1987 | Grace | |
| 4,704,316 | A | 11/1987 | Grace | |
| 4,711,684 | A | 12/1987 | Coleman | |
| 4,711,689 | A | 12/1987 | Coleman | |

(Continued)

FOREIGN PATENT DOCUMENTS

| | | |
|---|---|---|
| GB | 2176791 | 1/1987 |

(Continued)

OTHER PUBLICATIONS

Jarck et al., Scrimber Lumber Surfaces Again in U.S. as Timtek, Jul. 2001, PanelWorld, p. 18-23.*

*Primary Examiner* — Eric Hug
*Assistant Examiner* — Anthony Calandra
(74) *Attorney, Agent, or Firm* — Morris Manning Martin LLP; John R. Harris; Daniel E. Sineway

(57) ABSTRACT

The present invention relates generally to the timber products industry, and particularly to methods and apparatus for the separation of bast fibers. More particularly, the present invention relates to methods and apparatus for use in the separation of inner core from outer bast of bast plants using soaking, cutting, and scrimming methods and apparatuses.

8 Claims, 10 Drawing Sheets

U.S. PATENT DOCUMENTS

| | | | | |
|---|---|---|---|---|
| 4,827,423 | A | | 5/1989 | Beasley et al. |
| 4,937,024 | A | | 6/1990 | Hickson |
| 5,106,697 | A | | 4/1992 | Whittemore |
| 5,161,591 | A | | 11/1992 | Sealey et al. |
| 5,246,652 | A | | 9/1993 | Hsu |
| 5,279,691 | A | | 1/1994 | Stickland |
| 5,441,787 | A | * | 8/1995 | Fujii et al. ..... 428/57 |
| 5,465,464 | A | * | 11/1995 | Chen et al. ..... 19/24 |
| 5,505,238 | A | | 4/1996 | Fujii |
| 5,662,760 | A | | 9/1997 | Tsuda |
| 5,755,917 | A | | 5/1998 | Barnes |
| 5,763,338 | A | | 6/1998 | Sean |
| 5,972,266 | A | | 10/1999 | Fookes et al. |
| 6,030,562 | A | | 2/2000 | Lehtinen et al. |
| 6,098,679 | A | | 8/2000 | Go et al. |
| 6,187,234 | B1 | | 2/2001 | Bonomo et al. |
| 6,263,773 | B1 | | 7/2001 | McAdoo et al. |
| 6,318,046 | B1 | | 11/2001 | Horsfield et al. |
| 6,344,165 | B1 | | 2/2002 | Coleman |
| 6,428,871 | B1 | | 8/2002 | Cozzolino |
| 6,533,890 | B1 | | 3/2003 | Berger et al. |
| 6,569,540 | B1 | | 5/2003 | Preston et al. |
| 6,635,141 | B2 | | 10/2003 | Horsfield et al. |
| 6,868,877 | B2 | | 3/2005 | Lines |
| 6,938,541 | B2 | | 9/2005 | Vomberg |
| 2002/0064622 | A1 | | 5/2002 | Courtney |
| 2003/0009043 | A1 | | 1/2003 | Partridge et al. |
| 2003/0026942 | A1 | | 2/2003 | Hejna et al. |
| 2003/0102052 | A1 | | 6/2003 | Lines |
| 2003/0224179 | A1 | | 12/2003 | Skinner et al. |
| 2004/0040625 | A1 | | 3/2004 | Knokey et al. |
| 2005/0037202 | A1 | | 2/2005 | Hejna et al. |
| 2005/0241743 | A1 | | 11/2005 | Mbachu et al. |
| 2005/0257888 | A1 | | 11/2005 | Williamson et al. |
| 2006/0060290 | A1 | | 3/2006 | Jarck |
| 2006/0086427 | A1 | | 4/2006 | Jarck |
| 2006/0125152 | A1 | | 6/2006 | Gardner et al. |
| 2007/0001337 | A1 | | 1/2007 | Bales |
| 2007/0122644 | A1 | | 5/2007 | Jarck |
| 2008/0110565 | A1 | | 5/2008 | Parker |

FOREIGN PATENT DOCUMENTS

| | | |
|---|---|---|
| WO | WO8502366 | 6/1985 |
| WO | WO8502367 | 6/1985 |
| WO | WO8502368 | 6/1985 |
| WO | WO8502369 | 6/1985 |
| WO | WO8502370 | 6/1985 |
| WO | WO8804983 | 7/1988 |
| WO | WO8911383 | 11/1989 |
| WO | WO2006036713 | 4/2006 |

* cited by examiner

SYSTEM AND METHOD FOR THE SEPARATION OF BAST FIBERS

CROSS REFERENCE TO RELATED APPLICATION

This application is a continuation-in-part application and claims the benefit under 35 U.S.C. §120 of U.S. Non-Provisional patent application Ser. No. 11/162,747, filed Sep. 21, 2005, by Walter Jarck, and entitled "A System and Method for the Manufacture of Reconsolidated or Reconstituted Wood Products", now U.S. Pat. No. 7,537,031, and U.S. Non-Provisional patent application Ser. No. 11/162,748, filed Sep. 21, 2005, by Walter Jarck, and entitled "Systems and Methods for the Production of Steam-Pressed Long Fiber Reconsolidated Wood Products", now U.S. Pat. No. 7,537,669, both of which claim the benefit of U.S. Provisional Patent Application No. 60/612,075, filed Sep. 22, 2004, by Walter Jarck, and entitled "Method and Apparatus for the Manufacture of Reconsolidated or Reconstituted Wood Products", all of which are incorporated herein by reference as if set forth herein in their entirety. This application claims the further benefit under 35 U.S.C. §119(e) of U.S. Provisional Patent Application No. 61/012,564, filed Dec. 10, 2007, and entitled "A System and Method for the Separation of Bast Fibers", which is also incorporated herein by reference as if set forth herein in its entirety.

TECHNICAL FIELD

The present invention relates to an improved method and apparatus for the separation of bast and core fibers from bast plants.

BACKGROUND

The present invention relates generally to the timber products industry, and particularly to methods and apparatus for the separation of bast fibers. Fibers and other materials from plants such as kenaf, flax, hemp, sisal, jute, ramie, bamboo, and even banana and cotton stalks, can be successfully used to create a wide range of products. These alternative plants are commonly referred to as "bast plants," or dicotyledonous plants, which are flowering plants with net-veined leaves.

Bast plants are comprised of two primary fibrous elements: the outer fiber, similar to bark or skin, referred to as "bast," and the inner fiber, referred to as "core." Both of these elements can be used for different and varying purposes, and to create a wide range of products. The core from the bast plants may be used to make paper, polyesters and other fabrics, or to create reconstituted or reconsolidated paneling and wood products, or it can even be burned as fuel. The bast of the bast plants may be used to make rope, yarn, or burlap, or to manufacture lightweight and burnable materials, preferably including car parts such as dashboards, door panels, seat linings and seat backs.

Bast plants are preferable for use for many reasons. First, as mentioned, the bast and core can both be used to create a variety of different products. Second, many bast plants have phenomenal growth rates, typically reaching a harvestable height of 12-18 feet in approximately 150 growing days, whereas other organic materials such as pine or other timber generally cannot be harvested for 7-40 years. Because bast plants grow so quickly, they are a vastly renewable resource. Also, bast plants typically contain low amounts of lignin, which is the resin that binds cellulose fibers in plants and trees together. Lower amounts of lignin makes it easier to separate the core during processing, and makes it easier to further process the core at a later time as compared to other organic materials. Additionally, bast plants characteristically yield 3-5 times more usable material per acre than pine and other timbers. Bast and core are also very lightweight, thus making them easier to transport and store as compared to heavier fibers and timber.

However, current manufacturing processes are unequipped to effectively process bast plants. The bast and core are both useful for different purposes and to create different products, but the compositions of the bast and core are such that the two components must be separated from each other to be processed effectively and efficiently. Also, this separation must be accomplished without damaging or altering the biological makeup of either component.

An inherent property of a bast plant is that the bast is extremely difficult to separate from the core. Most previous processes separated the bast from the core by a human labor process called "retting," which essentially involves soaking the bast plant for a long period of time and then hand-peeling or chopping the bast off of the core of the plant. This retting process is not only tedious and time consuming, but also inefficient as it prevents large amounts of bast fiber from being processed quickly and effectively because each bast plant must be individually peeled. Because of this long felt, but unresolved problem, industry has previously avoided the widespread use of bast plants.

Therefore, it is an aim of the present invention to provide a method and apparatus that effectively and efficiently separates bast fibers.

BRIEF SUMMARY OF THE DISCLOSURE

The present invention relates to a system and method for the separation of bast fibers.

An embodiment of the present invention comprises a method for the separation of bast fibers. The method comprises the steps of soaking the bast fiber stalks in a hot water bath for a short period of time to loosen and soften the bast from the core. If the stalks are freshly-harvested, meaning they have been cultivated within approximately two weeks prior to processing, then the stalks may not require soaking in the hot water bath. The method further comprises the step of respectively feeding each stalk or a plurality of stalks into a plurality of scrim stations either sequentially or in groupings of a predetermined amount, each scrim station comprising a plurality of sets of scrim rolls for effectively separating the bast fibers from the core fibers of the stalk, and for softening of the outer bast of the stalk. Further, the scrim roll sets are configured to comprise a top scrim roll and a bottom scrim roll. The method further comprises the step of operating the last scrim roll set in the line of scrim stations at a speed moderately faster than the speed of the previous sets such that the previous scrim roll sets effectively hold the stalk in place while the last scrim roll set strips the bast from the core.

An aspect within the present embodiment comprises the step of respectively scanning each stalk in order to acquire data in regard to the diameter of a large and a small end of the stalk. Next, at a cutting station, the first and the second end of the stalks are cut at a predetermined angle of cut in order to enhance subsequent stalk scrim processing, the angle of cut being variable in a range greater than 15° and less than 60°.

A further aspect within the present embodiment comprises the step of feeding the stalks through a flailing station prior to soaking the stalks in the hot water bath, wherein any limbs, branches, leaves or stubs are removed from the stalks. This flailing station may comprise two opposing rollers with flailing instruments attached thereto. If the bast plants are freshly-harvested, then flailing is necessary to remove unwanted branches and limbs, and leave only the bast stalks for processing. If the plants are not freshly-harvested, then the flailing step may be unnecessary because the limbs and branches will break off easily during the scrimming process.

A yet further aspect within the present embodiment comprises the step of feeding the stalks through a stalk incisor prior to sending the stalks through the scrim stations to produce longitudinal cuts or slices along the length of the stalks before the stalks are scrimmed. The stalk incisor may be similar in configuration to a "spike" roll, or may comprise rollers with blades aligned around the circumference of the rollers perpendicularly to the axis of the rollers. The longitudinal cuts help initiate and control the width of splits within a stalk, and improve the quality of subsequently produced scrim stalk material.

A still further aspect within the present invention comprises the step of cutting the stalks via a post-processing cutting station after the stalks are scrimmed, wherein the stalk material is cut to predetermined and desired lengths.

Another embodiment of the present invention comprises a system for the separation of bast fibers. The system comprises a hot water bath for soaking a plurality of stalks, wherein the stalks are soaked for a short period of time to soften and loosen the bast from the core. If the stalks are freshly-harvested, then soaking may be unnecessary. The system further comprises a plurality of scrim stations, each scrim station comprising a plurality of sets of scrim rolls for crushing and refined cutting of the stalk, softening of the bast of the stalk, and separating the bast from the core of the stalk, the scrim sets being configured to comprise a top scrim roll and a bottom scrim roll.

A stalk scanning device is also included for scanning each stalk in order to acquire data in regard to the diameter of a large and a small end of the stalk. Additionally, the first and the second end of the stalks are cut at a predetermined angle of cut in order to enhance stalk scrim processing, the angle of cut being variable in a range greater than 15° and less than 60°.

The system further comprises a final scrim roll set in the line of scrim stations that operates at a speed moderately faster than the speed of the previous sets such that the previous scrim roll sets effectively hold the stalk in place while the last scrim roll set strips the bast from the core of the stalk.

A further aspect of the present embodiment comprises a flailing station, wherein any limbs, branches or stubs are removed from the stalks. This flailing station may comprise two opposing rollers with flailing instruments attached thereto. If the bast plants are freshly-harvested, then flailing is necessary to remove unwanted branches, leaves and limbs, and leave only the bast stalks for processing. If the plants are not freshly-harvested, then the flailing device may be unnecessary because the limbs and branches will break off easily during the scrimming process.

A yet further aspect of the present embodiment comprises a stalk incisor for producing longitudinal cuts or slices along the length of the stalks before the stalks are scrimmed. The stalk incisor may be similar in configuration to a "spike" roll, or may comprise rollers with blades aligned around the circumference of the rollers perpendicularly to the axis of the rollers. The longitudinal cuts help initiate and control the width of splits within a stalk, and improve the quality of subsequently produced scrim stalk material.

A still further aspect within the present embodiment comprises a post-processing cutting station, wherein the stalk material is cut to predetermined and desired lengths after it exits the scrimming stations.

Another aspect of the present invention comprises a computer program product that includes a computer readable medium that is usable by a control unit processor. The medium having stored thereon a sequence of instructions that when executed by a control unit processor causes the control unit processor to execute the step of scanning a stalk in order to acquire data in regard to the diameter of a large and a small end of the stalk. The computer program product further determines the optimum spacing between a top scrim roll and a bottom scrim of a plurality of scrim roll sets based upon the acquired diameter of the large and small ends of the scanned stalk. The computer program product further comprises the step of dynamically adjusting the spacing between the top scrim roll and the bottom scrim roll of the scrim roll sets based upon the determined optimum spacing of each scrim roll set. The computer program product further comprises the step of dynamically adjusting the speed at which the scrim rolls turn, including the last, faster-spinning scrim roll set, based upon the acquired diameter of the large and small ends of the scanned stalk.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION

Figure 1:
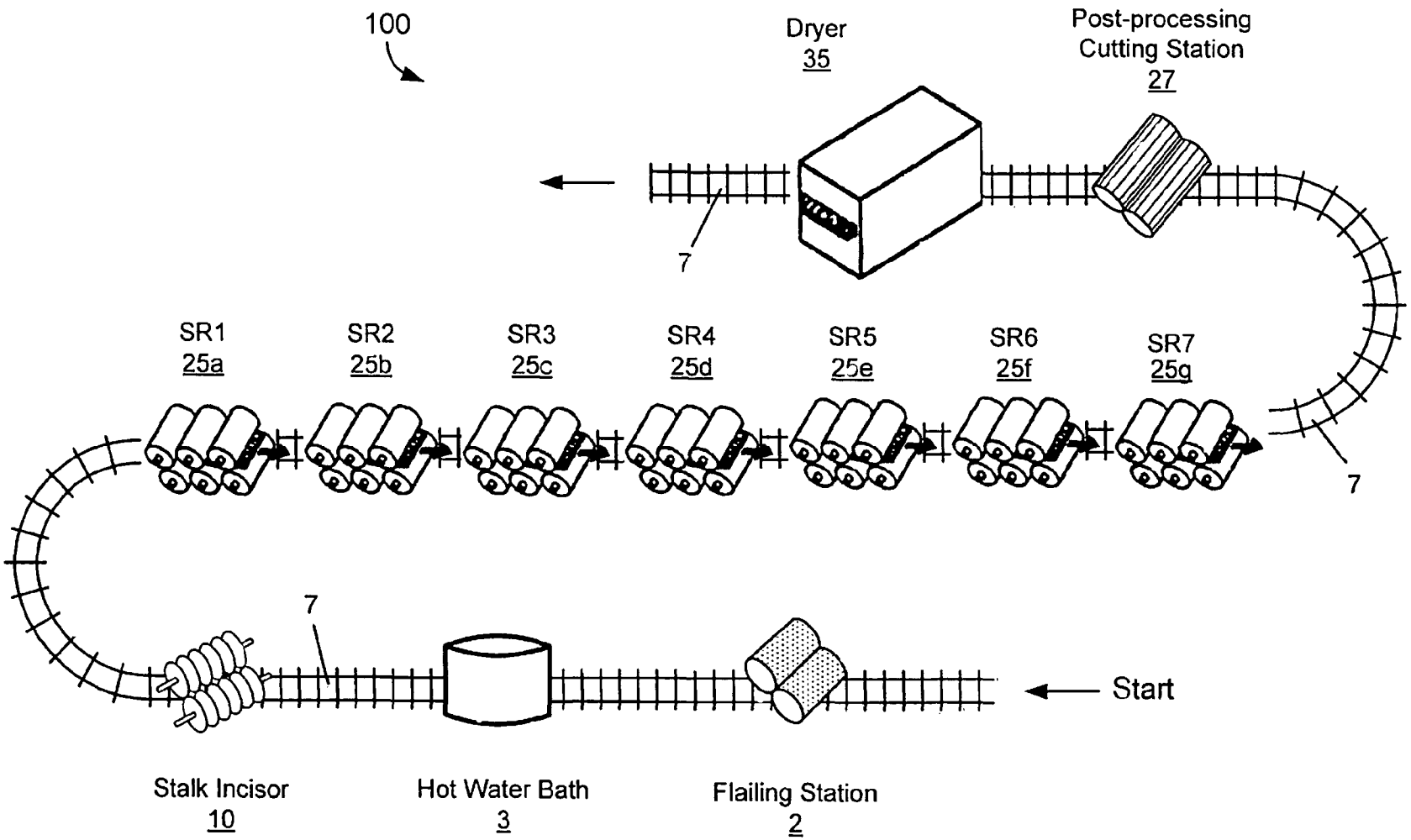
FIG. 1 is a diagram illustrating a production line system for the separation of bast fibers that may be implemented in embodiments of the present invention.

One or more exemplary embodiments of the invention are described below, the disclosed embodiments are intended to be illustrative only since numerous modifications and variations therein will be apparent to those of ordinary skill in the art. Further, all embodiments of the present invention may either be implemented, assisted or controlled via computerized control systems, wherein the computerized control systems can be a conventional personal computer system. The computing systems further include user interfaces that operate in accordance with conventional windowing graphical user interface (GUI) paradigms.

The computerized control systems can further comprise additional hardware and software elements of the types generally included in conventional personal computers, such as a processor, a main memory, a disk storage device such as a hard disk drive, input/output interfaces, an image scanner, a mouse, a keyboard and a removable read/write storage device such as a drive that uses a CD-ROM or a floppy disk.

The software elements of the computerized control system are executable in the main memory, but as persons skilled in the art will understand, the software elements may not in actuality reside in its entirety in the main memory. The computerized control systems can further comprise other hardware and software elements of the types conventionally included in personal computers, such as an operating system.

The stalks or stems utilized within aspects of the present invention are preferably freshly harvested. Freshly-harvested stalks are defined as those which have been cultivated within 2 weeks prior to processing. Accordingly, the stalks must be promptly used or, in the event the stalks are not promptly used, liberally sprinkled with water in order to prevent the stalks from drying out. The stalks come preferably from bast fiber plants, namely kenaf, flax, hemp, sisal, jute, ramie, bamboo, banana plants, cotton plants, and the like. Stalks that are used within aspects of the present invention should preferably have a first and second end with the large-end diameters of the stalks being in the range of about 0.25 to 4 inches and the length of the stalks being in the range of about 10 to 20 feet, although as one having ordinary skill in the art will understand, the stalks may be larger or smaller than those described.

For bast plants, effective removal of the outer fiber ("bast") from the inner fiber ("core") is critical for satisfactory processing of either the bast or core materials. The separation of the bast from core is extremely difficult, and has effectively prevented the previous use of bast fibers in industry. Previous attempts at separating the core from the bast have used either chemical processes that alter the makeup of the plant, or crude mechanical processes that damage or affect the fibrous materials. Thus, the effective separation of the bast from the core is an essential and novel feature within aspects of the present invention.

The quality of any resultant product made from the bast or core is predicated upon the quality of the scrim stalk material that is produced via the stalk processing line. An important step in producing quality scrim stalk material, and in the removal of the bast from the core, is the initial conditioning of the stalks by immersing them in a hot water bath prior to the stalks being scrimmed. If the stalks are freshly-harvested, then immersing the stalks in the hot water bath may not be necessary. But, if the stalks are not freshly-harvested, and are thus dried out, then soaking the stalks may be necessary. Although freshly-harvested stalks are preferable, even if they are not freshly-harvested, stalks that are heated in a water bath for a short period of time result in satisfactory scrim material. The hot water bath softens and moistens the bast plants which allows the bast to be removed from the core more cleanly and easily. Because the bast is cleanly removed, the use of the hot water bath results in uninjured bast and core fibers, both of which are highly desired.

It is important within aspects of the present invention that conditioned stalks not be soggy or over saturated from the soaking or conditioning process; preferably conditioned stalks need to retain some degree of crispness so that they split easily into stalk length strands. Conditioned stalks should be quickly processed through the present system. The over conditioning of a stalk can result in knots within the stalk that become too soft to separate from the strands of the crushed and scrimmed material of the stalk.

Aspects of the present invention are initially described in reference to FIG. 1. FIG. 1 illustrates an overall processing line system 100 that may be implemented within embodiments of the present invention. The specific stations and processing areas within the process line system 100 can be configured as desired. As shown, the preferred system 100 of FIG. 1 comprises a flailing station 2, a hot water bath 3, a stalk incisor 10, scrim roll stations 25*a*-25*g*, a post-processing cutting station 27, and a dryer 35.

As shown in FIG. 1 in an aspect of the present invention, stalks and processed stalk materials are transported throughout the system 100 from station to station via a conveyor transport system 7. The speed and direction of the conveyor transport system is controlled and directed via a computer control system.

The preferred embodiment of the system 100 comprises a flailing station 2, wherein limbs, branches and stubs are removed from the stalks. This flailing station 2 may comprise two opposing rollers with flailing instruments attached thereto. The flailing instruments may comprise soft wire brushes, rubber fingers, or any other pliable, semi-rigid members capable of removing the leaves and limbs from the bast stalks without interfering with or damaging the bast fibers. The two opposing rollers spin as the stalks are fed between them, and the flailing instruments detach limbs, leaves, stubs, and any other unwanted materials from the bast stalks. If the bast plants are freshly-harvested, then flailing is necessary to remove unwanted branches and limbs, and leave only the bast stalks for processing. If the plants are not freshly-harvested, then the flailing step may be unnecessary because the limbs and branches will break off easily during the scrimming process.

After the flailing station 2, the dried stalks are transported to the hot water bath 3, wherein the bast stalks are soaked for a short period of time to soften and loosen the outer bark from the inner fibers. If the stalks are freshly-harvested, then soaking the stalks may be unnecessary. The temperature of the water comprising the hot water bath should be in the range of 110-150° F. so that the stalks will soften and soak up the water more quickly. The stalks are soaked for different lengths of time depending on the size of each stalk. Stalks that are 1" or less in diameter generally only need to be soaked for approximately half an hour to reach optimal moisture content and temperature. Stalks that are larger than 3" in diameter generally should be soaked for 1.5 hours or longer, depending on the size of the stalk. Bast stalks between these size ranges should be soaked for time periods greater than half an hour but less than 1.5 hours, depending on the size of the stalk. Regardless of the size of the diameter of the stalk, optimum temperature and moisture content is reached when the inner temperature of the stalk is approximately 120° F. The soak in the hot water bath 3 enables the stalks to be processed more easily and efficiently.

Upon removal from the hot water bath 3, conditioned stalks are deposited upon the conveyor transport system 7, wherein the conveyor transport system 7 transports the stalks to the stalk incisor 10 prior to entering the first scrimming station 25. Before the stalks are cut via the stalk incisor 10, the stalks are scanned by a stalk-scanning device (not shown) in order to acquire measurement data in regard to the diameter of a large and a small end of each stalk. This data will aid in setting the distance between the rollers included in the stalk incisor 10 and scrimming stations 25.

In an additional aspect of the present invention, as shown in FIG. 1, a stalk incisor 10 is utilized to produce longitudinal cuts or slices along the length of the stalks before the stalks are scrimmed. The stalk incisor 10 may be similar in configuration to a "spike" roll, or may comprise rollers with blades aligned around the circumference of the rollers perpendicularly to the axis of the rollers. The longitudinal cuts help initiate and control the width of splits within a stalk, and improve the quality of subsequently produced scrim stalk material.

Further aspects of the present invention provide for a cutting station (not shown) wherein the first and the second end of the stalks are cut at a predetermined angle of cut in order to enhance the subsequent stalk scrimming process. The angle of cut of the stalk ends is preferably variable in a range greater than about 15° and less than about 60°.

As mentioned above, aspects of the present invention comprise a plurality of scrim stations 25*a*-25*g*; each scrim station 25*a*-25*g* comprises pluralities of sets of scrimming rolls for the crushing and refined cutting of the bast stalk. As will be understood, a scrim station 25*a*-25*g* may comprise only one scrim roll set, or many scrim roll sets. Within aspects of the present invention, a scrimming set comprises a top scrim roll and a bottom scrim roll. The primary objective of the scrimming stations 25*a*-25*g* is to effectuate the separation of the bast fiber from the core fiber of the stalk. Another objective is to produce a group of separately defined, but not discrete, strands in which most of the strands are the length of the stalk and evenly separated from each other so as to produce a mat with a consistent basis weight. FIG. 1 illustrates a set of seven stalk scrimming stations 25*a*-25*g*. As will be understood by one having ordinary skill in the art, other embodiments of the present invention may comprise as many or as few scrim stations 25*a*-25*n* as needed to provide the desired texture and consistency of a specific scrim stalk material. Further, as illustrated in FIGS. 2A-2J, the scrim rolls can comprise varied sizes and spacing between the top and bottom rolls, as well as varying surfaces and textures on the rolls.

It has been observed in previous stalk material processing operations that oscillating scrim rolls can do considerable damage to processed scrim stalk material, therefore, the traditional oscillating scrim rolls have been replaced within aspects of the present invention with stationary adjustable fluted scrim rolls. The majority of the scrim rolls used within aspects of the present invention comprise fluted grooves that appear similar to ruffles in appearance. The fluted grooves of respective scrim roll sets comprise specific pitches, wherein the pitch of a flute is determined by the angle formed by two adjacent sides of a protruding flute segment. The last set of scrim rolls may comprise simply a rough surface or texture, or smaller, axially-aligned grooves, rather than fluted grooves, depending on the freshness of the stalk.

As illustrated in the scrim roll profiles of FIGS. 2A-2H, the pitch of a flute and the flute depth of a scrim roll profile vary as the stalk proceeds through a plurality of scrim roll stations 25*a*-25*g*. In particular, the pitch distance—or the distance between two flute groove sides—determines the size of the scrim flute elements, while the depth of the flutes determines the amount of separation between the scrim elements. The pitch distance, and the depth and the angle the flute grooves make with the shaft are all important considerations in achieving consistent scrim quality.

As the stalk material is passed through each scrim station 25*a*-25*g*, the distance or space gap between each consecutive scrim roll set becomes progressively smaller, thus resulting in a finely crushed stalk material mat or scrim stalk material mat. This specific design assists in reducing the diameter of the scrim in a series of consecutive stages without reducing the strength of the scrim fiber strands. The design of the profiles on each of the respective scrimming stations is different (as illustrated in FIGS. 2A-2G).

In the preferred embodiment of the present invention, the number of scrimming roll sets actually used for a particular bundle of bast stalks typically depends upon the freshness and size of the stalks. For instance, fresher stalks which have been harvested within 2 weeks of processing may only require the use of two or three scrim roll sets to become sufficiently separated, whereas older stalks that have been stored for a long period of time may require processing through several scrim roll sets. The number of scrim roll sets used, whether it is as few as two, or many more than two, can be varied by the system user at his or her discretion.

Figure 2A:
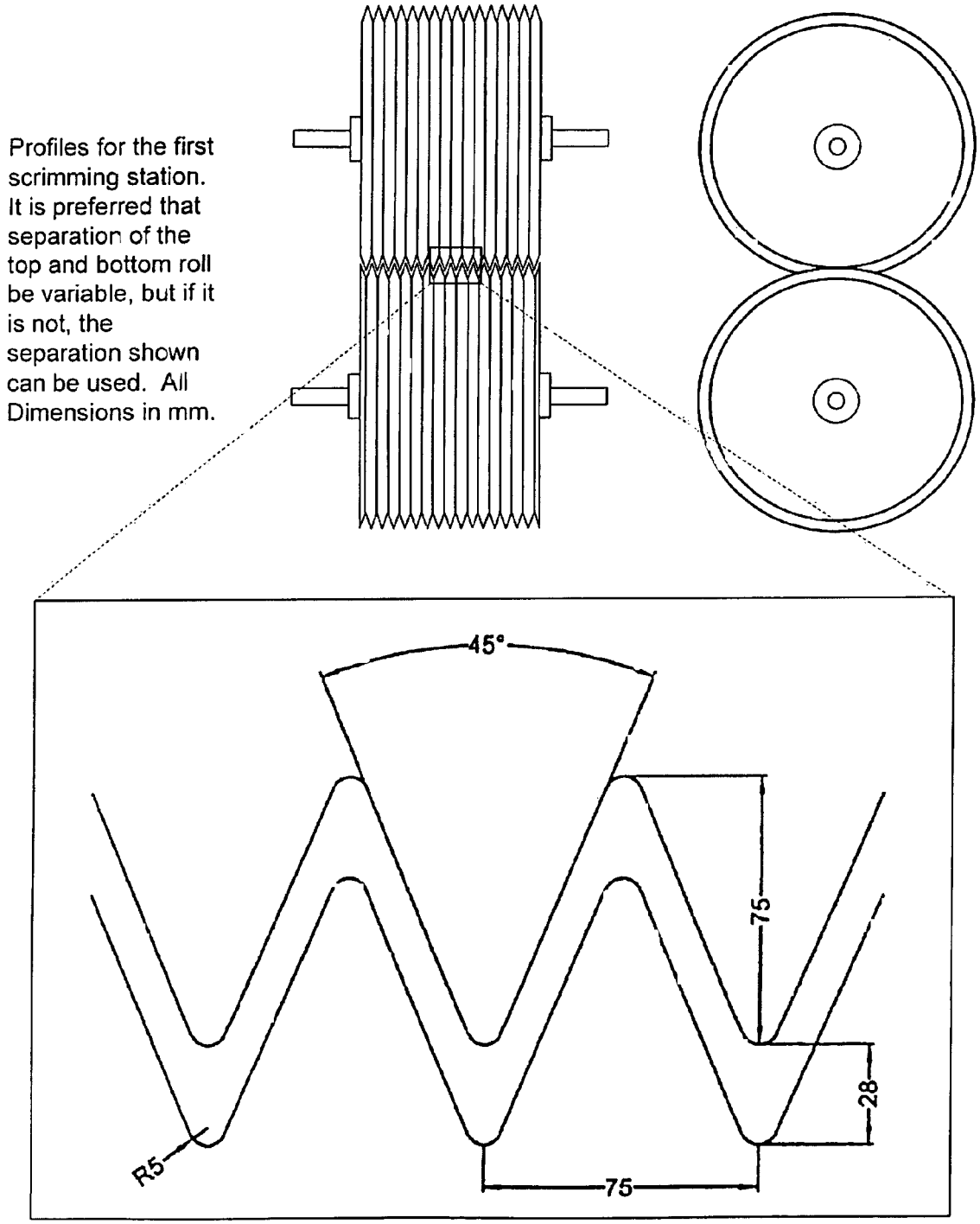
FIGS. 2A-2J are diagrams illustrating profiles of scrim rolls that may be implemented in scrimming stations that are utilized within embodiments of the present invention.
Figure 2B:
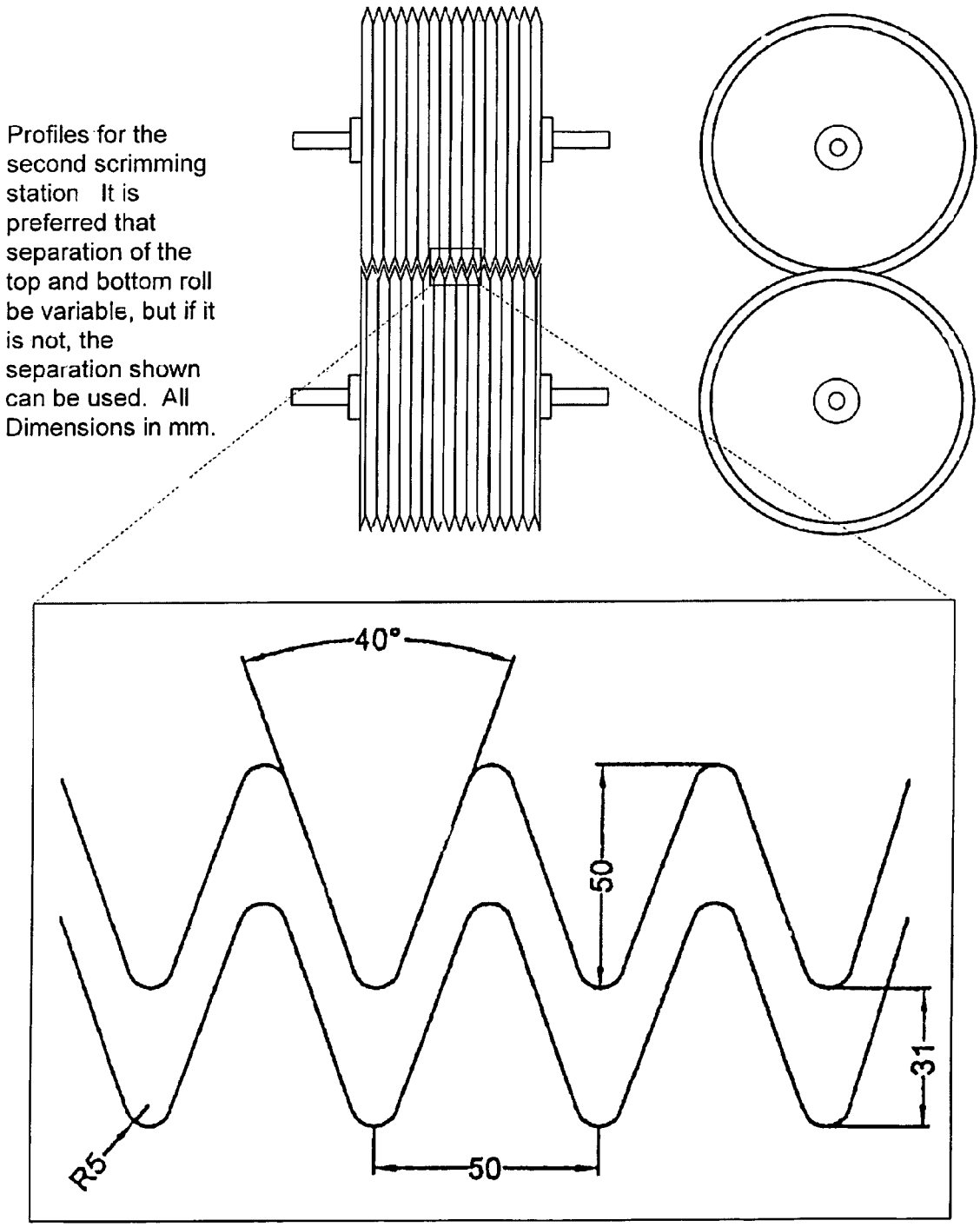
Figure 2C:
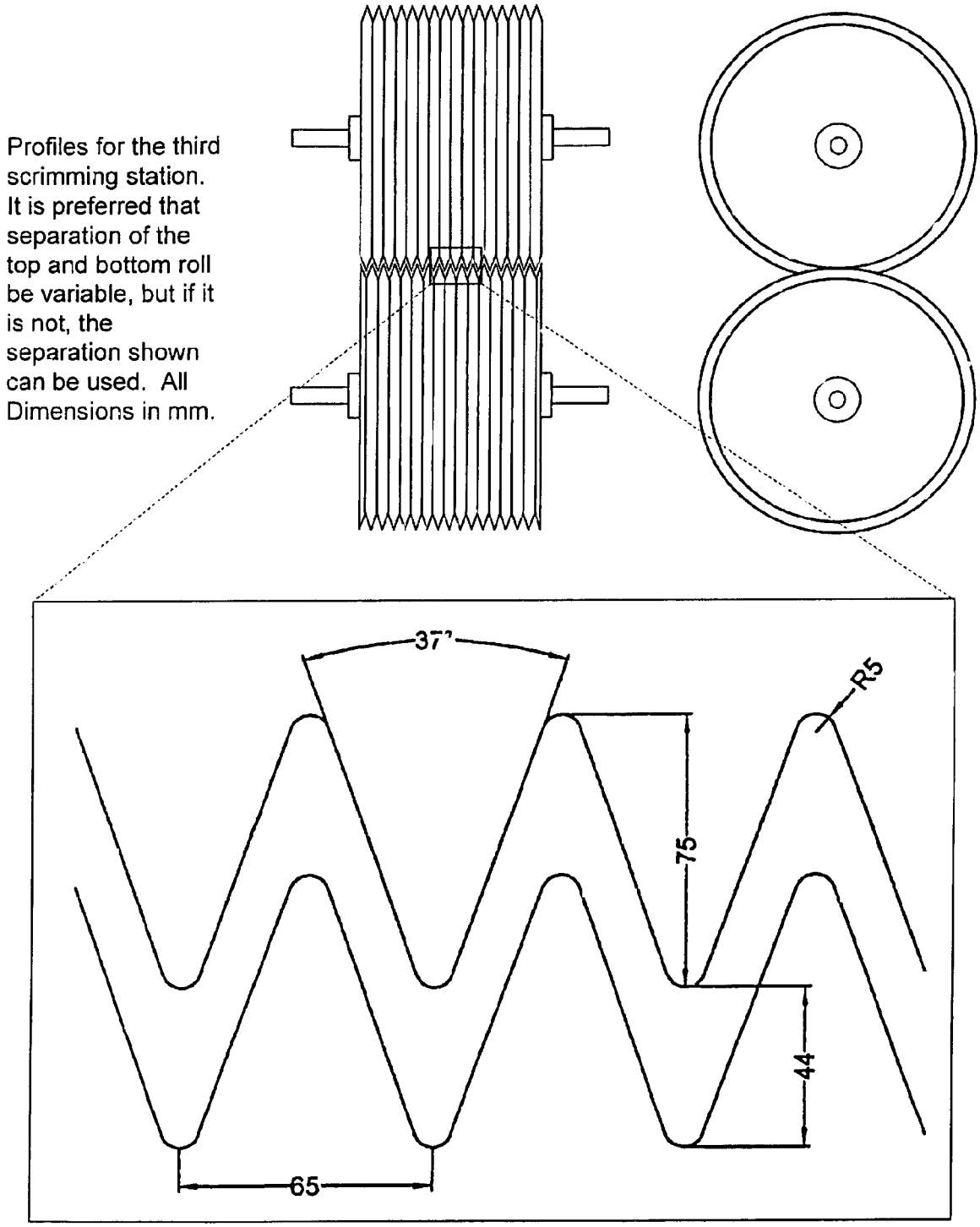
Figure 2D:
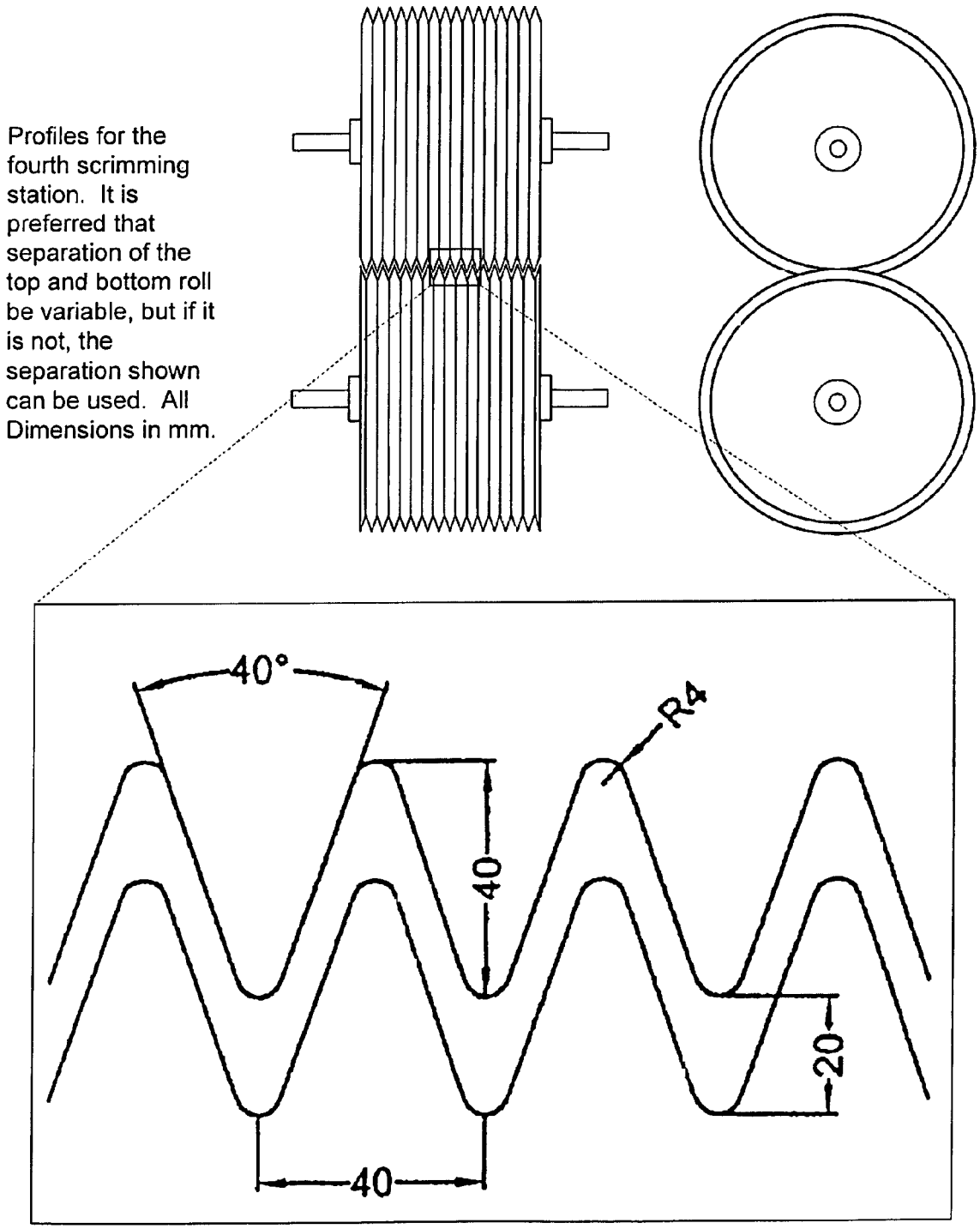
Figure 2E:
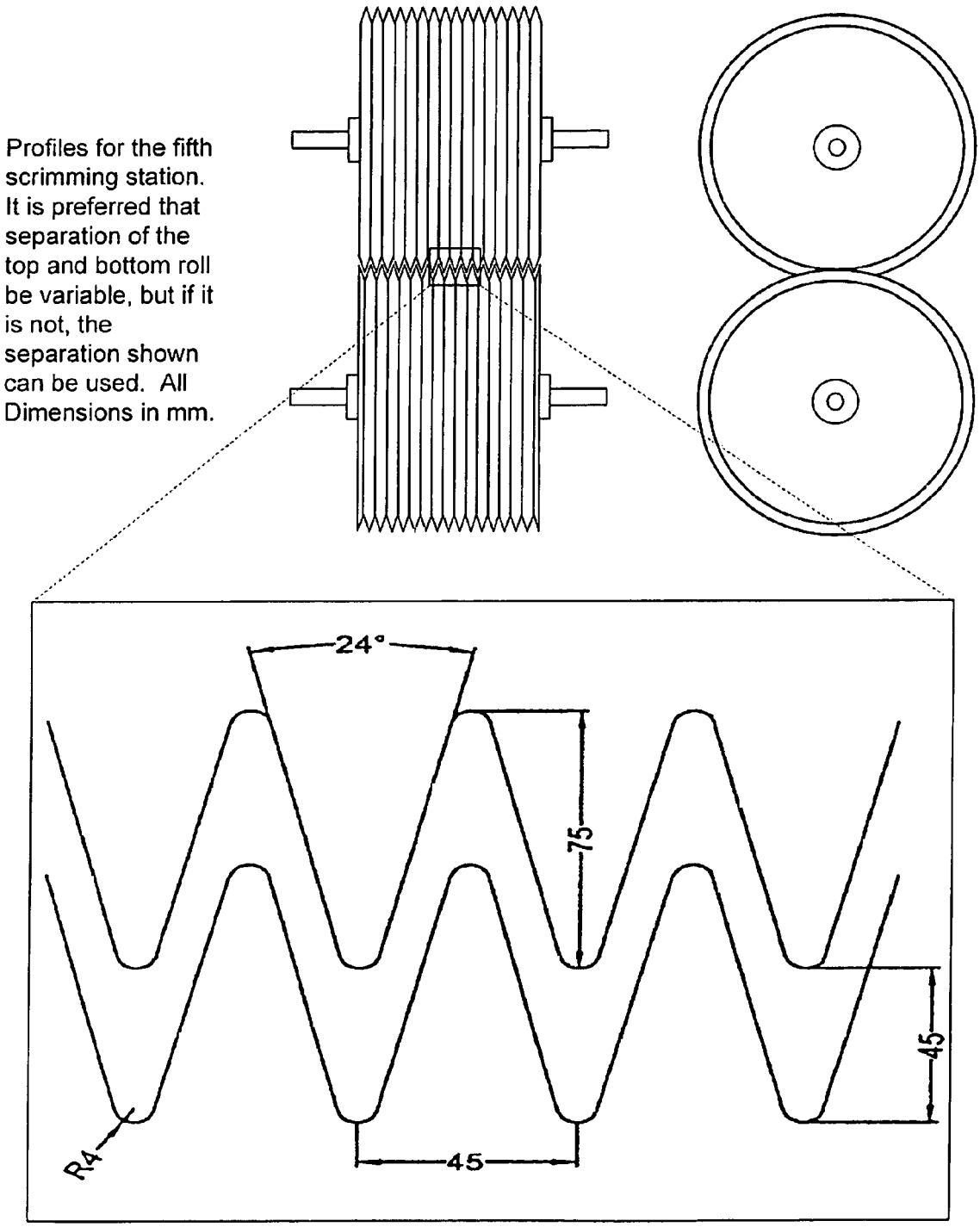
Figure 2F:
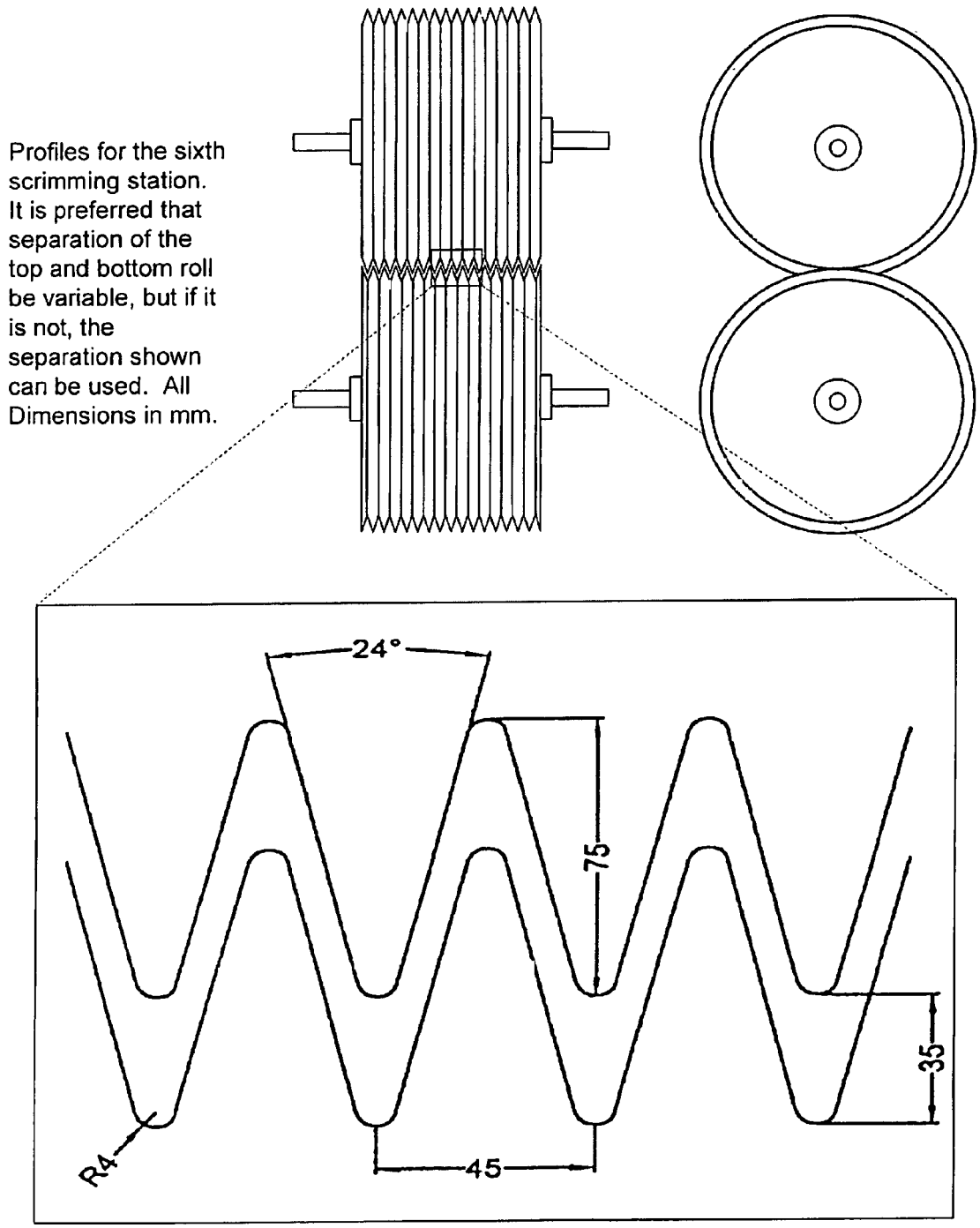
Figure 2G:
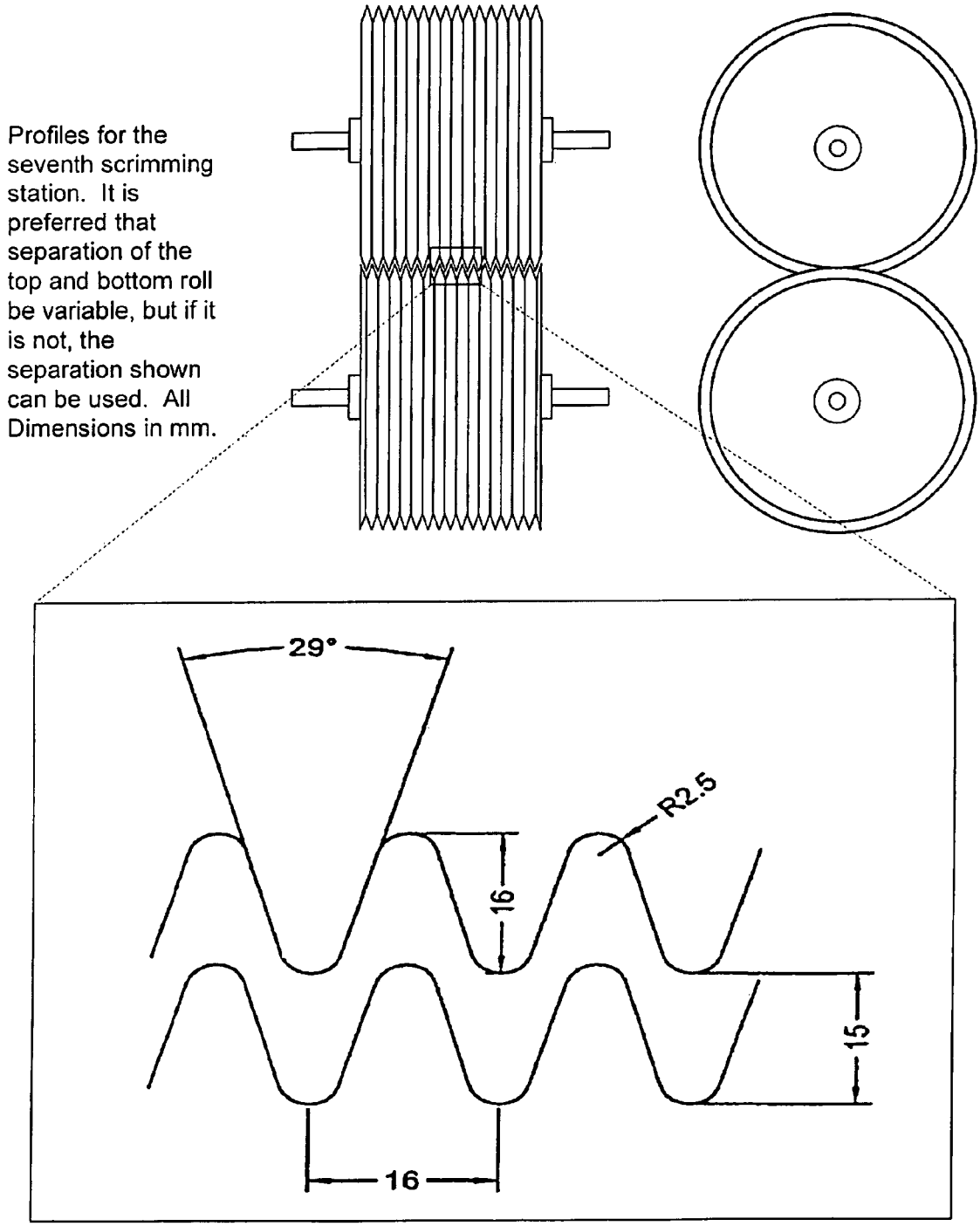
Figure 2H:
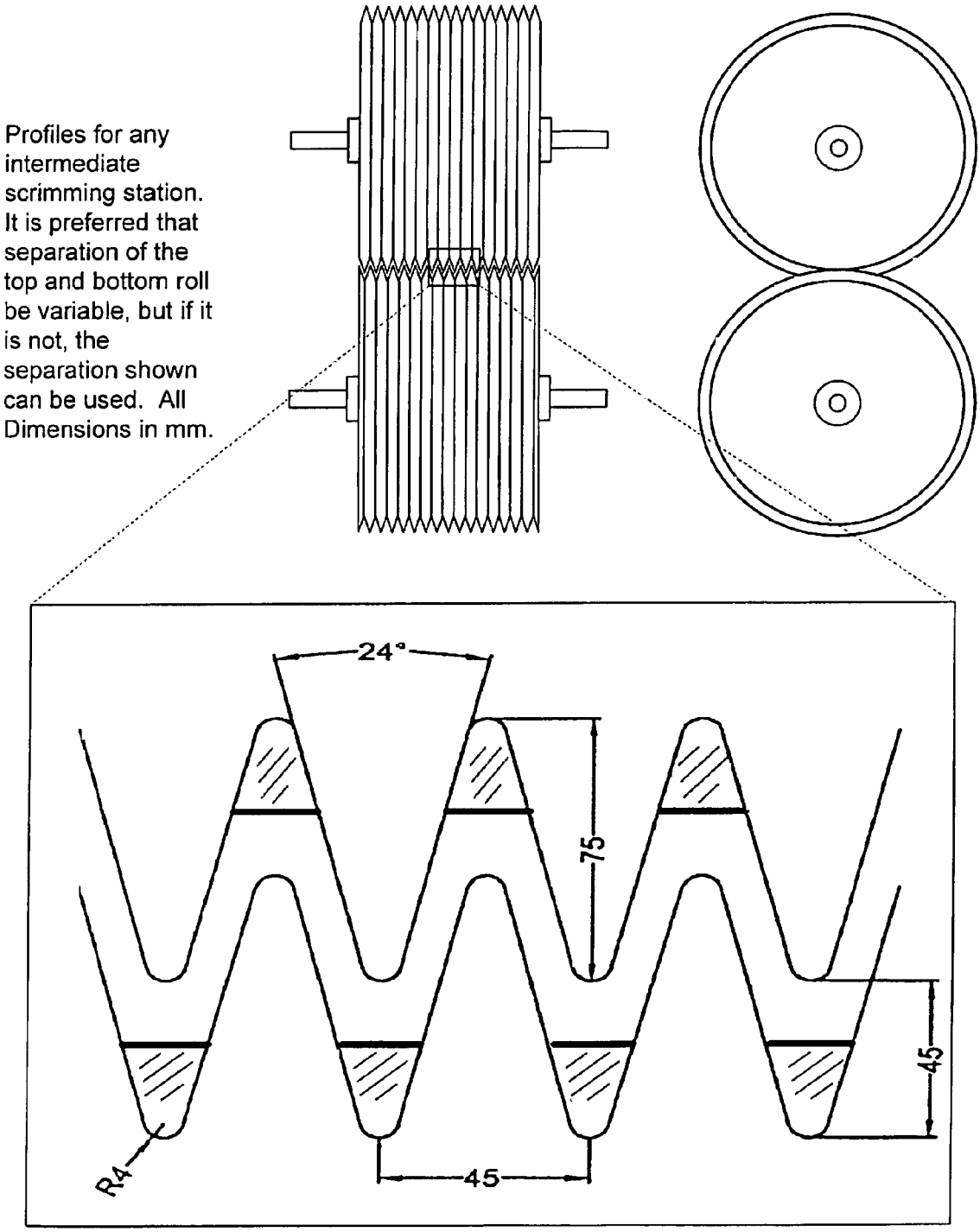
Figure 2I:
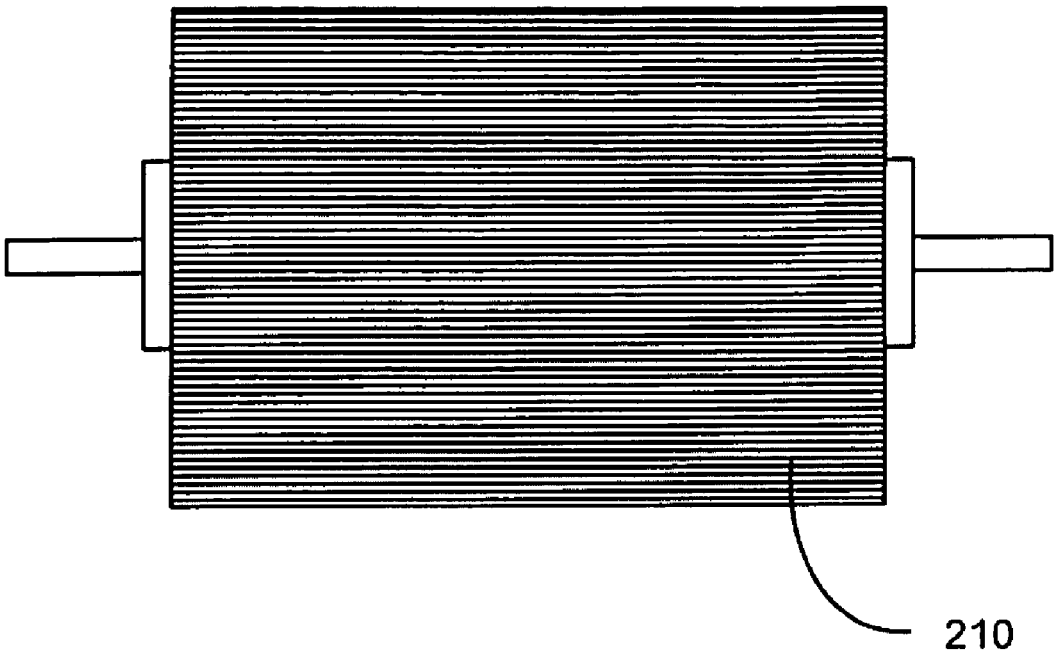

Within further aspects of the present invention, as illustrated in FIG. 2H, alternative scrim roll profiles may be implemented at any scrim roll station within the system 100. As seen in FIG. 2H, the flute depth of a scrim roll can be reduced, while the pitch distance remains the same. As shown in FIG. 2H, either filling the flute groove with a durable substance or not machining the flute groove to its entire depth at the manufacture of the scrim roll can reduce the flute depth of a scrim roll. The scrim roll configuration of FIG. 2H assists in clearing processed scrim from a scrim roll set and thus can be implemented on a scrimming line in the instances where there is constant trouble within a production process from the strands of the scrim becoming lodged within the scrim rolls during the scrimming process.

Figure 2J:
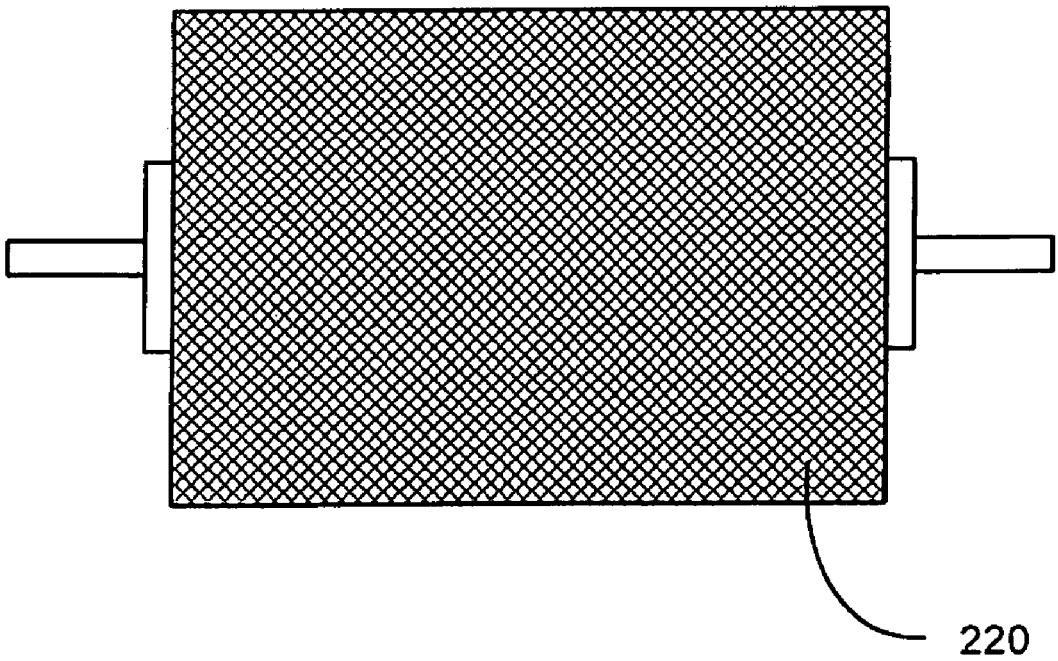

An aspect of the present invention is a final stalk scrimming set (which would be included within scrimming station 25*g* in the present embodiment) that has an outer roll surface different than the fluted design present in the other scrim roll sets. A shown in FIG. 2I, this final roll set may include small ridges 210 axially aligned along the scrim roll, as compared to the flutes of the other sets shown in FIGS. 2A-2H, which are aligned perpendicular to the axis of the scrim rolls. Alternatively, as shown in FIG. 2J, the final scrim roll set may simply comprise a rough or coarse outer surface 220, or any other similar surface. As previously mentioned, the purpose of these alternative outer surfaces is to strip the bast from the core of the stalks, thus separating these two discrete elements for use. In some embodiments, as few as two scrim roll sets are used; one set comprising scrimming rolls with a fluted design, and a final set comprising rolls with an alternative outer surface. As will be understood, the number of scrim roll sets and scrim roll stations 25*a*-25*g* may be varied by a system operator.

Within further aspects of the present invention, the last scrim roll set should be rotated at a faster speed than the earlier scrim roll sets in the process such that the last scrim roll set strips the bast from the core while the earlier sets effectively hold the stalks in place. The bast is separated because the rough surfaces, either 210 or 220 or some other coarse surface, are spinning against the outer bast fiber faster than the stalk is moving through the scrimming station, and thus the bast is removed from the stalk as it moves through the last scrim roll set. This last scrim roll set is operated in a range of approximately 5% to 15% faster than previous scrim roll sets to easily and gently rub the bast fiber off of the core material. Preferably, this last scrim roll set should be operated at a speed approximately 10% faster than the earlier scrim roll sets, but as one having ordinary skill in the art will understand, any number of speeds may be used to accomplish the separating function. Bast and core fibers comprise different compositions and properties, and thus these two elements will be clearly and discretely defined after exiting the final scrim roll set.

As mentioned above, an objective of the scrimming stations 25*a*-25*g* is to produce a group of separately defined, but not discrete, strands in which most of the strands are the original length of the stalk in addition to being evenly separated from each other, and to subsequently remove and separate the outer bast from the inner core of the bast plant. This aspect of the present invention is enhanced by the ability to dynamically control the spacing between a discrete scrim roll set, and the speed at which the scrim roll set is operating. This feature is accomplished by utilizing the stalk diameter data that was obtained at the stalk scanning station to determine the optimum spacing between the top and bottom scrim roll of a scrimming roll set. Once the optimum spacing is established for a respective scrim roll set, the scrim roll set can be configured to the established optimum spacing by either a manual means or via a computerized control system within aspects of the present invention.

In some instances, as stalks are being processed at the scrimming stations 25*a*-25*g* the leading edges of some stalks may have a tendency to produce larger scrim stalk material than is desired. Aspects of the present invention provide a solution to this particular problem. Specifically, prior to entering a predetermined scrim station 25*a*-25*g* the scrim stalk material is rotated 180°, which provides an appropriate remedy to this particular problem. This orientation changing feature places larger scrim stalk material on the back sides of the remaining scrim station 25*a*-25*g* roll sets and thus results in a more homogeneous scrim stalk material mat. Within further aspects of the present invention, the scrim stalk material can be separated into predetermined mat bundle sizes at pre-specified scrimming stations 25*a*-25*g* situated upon the stalk processing line.

Within aspects of the present invention, after the stalk material exits the scrimming stations 25*a*-25*g*, it will progress through a post-processing cutting station 27 wherein the stalk material is cut to predetermined and desired lengths. The post-processing cutting station 27 preferably comprises two opposing rollers with axially-aligned blades that slice the scrim stalk material into smaller lengths, but may comprise any mechanism for the cutting of the scrim stalk material, such as a guillotine-type cutter. The scrim stalk material may be cut into lengths as short or as long as the user desires, depending on the spacing of the blades on the rollers of the post-processing cutting station 27. Alternatively, the post-processing cutting station 27 may be omitted if the user desires longer, uncut, stalk-length material.

Once the scrim stalk material has exited the scrimming stations 25*a*-25*g*, the scrim stalk material is transported to a first drying station 35 (see FIG. 1). Within aspects of the present invention, wet scrim stalk material is dried at the drying station 35 using a simple air drying mechanism. In one embodiment of the present invention, the air used for drying should be at a temperature in the range of 180° to 280° F. The residual moisture content range for the dried scrim stalk material is preferably in the range of 5% to 20%, but as will be understood by one having ordinary skill in the art, the moisture content may be outside of this range.

After the scrim stalk material is sufficiently dried, it is gathered and baled for use. Because both the bast and core have not yet been mechanically damaged or chemically altered, they may be used in numerous applications. The bast may be further processed into lightweight materials, preferably including car parts such as dashboards, door panels, and seat backs and linings. The core may be processed into polyesters or other synthetics, or may be used in any application requiring a strong and durable composite material. In one aspect of the present invention, the core may be further processed into reconsolidated or reconstituted wood products.

A further embodiment of the present invention comprises a method for the separation of bast fibers. The method comprises the step of soaking the bast fiber stalks in a hot water bath for a short period of time for softening and loosening the outer bast from the inner core of the stalk. Stalks that are freshly-harvested may not require soaking in the hot water bath. The method further comprises the step of sequentially feeding each stalk into a plurality of scrim stations, each scrim station comprising a plurality of sets of scrim rolls for the separation of bast and core fibers, the scrim roll sets being configured to comprise a top scrim roll and a bottom scrim roll. The method further comprises the step of operating the last scrim roll set in the line of scrim stations at a speed moderately faster than the speed of the previous sets such that the previous scrim roll sets effectively hold the stalk in place while the last scrim roll set separates the bast from the core fiber. The last scrim roll set may either comprise grooves which are axially-aligned along the roll, or alternatively, a rough surface on the outside of the scrim roll, to aid in the removal of the bast from the core of the stalk.

An aspect within the present method includes the step of respectively scanning each stalk in order to acquire data in regard to the diameter of a large and a small end of the stalk. Next, the first and the second end of the stalks are cut at a predetermined angle of cut in order to enhance stalk scrim processing, the angle of cut being preferably variable in a range greater than 15° and less than 60°.

A further aspect within the present embodiment comprises the step of feeding the stalks through a flailing station prior to soaking the stalks in the hot water bath, wherein any limbs, branches or stubs are removed from the stalks. This flailing station may comprise two opposing rollers with flailing instruments attached thereto. If the bast plants are freshly-harvested, then flailing is necessary to remove unwanted branches and limbs, and leave only the bast stalks for processing. If the plants are not freshly-harvested, then the flailing step may be unnecessary because the limbs and branches will break off easily during the scrimming process.

A yet further aspect within the present embodiment comprises the step of feeding the stalks through a stalk incisor prior to sending the stalks through the scrim stations to produce longitudinal cuts or slices along the length of the stalks before the stalks are scrimmed. The stalk incisor may be similar in configuration to a "spike" roll, or may comprise rollers with blades aligned around the circumference of the rollers perpendicularly to the axis of the rollers. The longitudinal cuts help initiate and control the width of splits within a stalk, and improve the quality of subsequently produced scrim stalk material.

A still further aspect within the present invention comprises the step of cutting the stalks via a post-processing cutting station after the stalks are scrimmed, wherein the stalk material is cut to predetermined and desired lengths.

Another embodiment of the present invention comprises a computer program product that includes a computer readable medium that is usable by a control unit processor. The medium having stored thereon a sequence of instructions that when executed by a control unit processor causes the control unit processor to execute the step of scanning a stalk in order to acquire data in regard to the diameter of a large and a small end of the stalk. The method further determines the optimum spacing between a top scrim roll and a bottom scrim roll of a plurality of scrim roll sets based upon the acquired diameter of the large and small ends of the scanned stalk. The computer program product further comprises the step of dynamically adjusting the spacing between the top scrim roll and the bottom scrim roll of the scrim roll sets based upon the determined optimum spacing of each scrim roll set.

Therefore, it will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for the separation of bast fibers comprising the steps of:

soaking a plurality of bast stalks in a hot water bath for softening outer bast material on the stalks, the stalks comprising a first and a second end;

respectively scanning each stalk with a scanning device in order to acquire data in regard to the diameter of the first and the second end of the stalk;

feeding the stalks through a stalk incisor to produce longitudinal cuts or slices along the length of the stalks to help initiate and control the width of splits within the stalks;

sequentially feeding the stalks into a plurality of scrim stations, each scrim station comprising a plurality of sets of spinning scrim rolls, the scrim roll sets being utilized to perform a refined crushing function upon the stalks, wherein the scrim sets comprise a top scrim roll and a bottom scrim roll, the result of the stalk scrimming step being a scrim stalk material;

operating a final scrim roll set at a speed moderately faster than the scrim roll set immediately preceding the final set for separation of the outer bast material on the stalks from inner core fibers within the stalks, wherein the final scrim roll set removes the outer bast material as the scrim roll set immediately preceding the final set effectively holds the stalk in place.

2. The method of claim 1, further comprising the step of feeding the stalks through a flailing station prior to soaking the stalks in the hot water bath, wherein the flailing station removes any limbs, branches or stubs from the stalks.

3. The method of claim 1, further comprising the step of cutting the stalks via a post-processing cutting station after the stalks are scrimmed, wherein the stalk material is cut to predetermined and desired lengths.

4. The method of claim 1, wherein the moderately faster speed at which the final scrim roll set is operating is between the range of approximately 5% to 10% faster than the speed of the scrim roll set immediately preceding the final scrim roll set.

5. The method of claim 1, wherein the stalk diameter data is utilized to determine the optimum spacing between the top and bottom scrim roll of the scrim roll sets.

6. The method of claim 5, further comprising the step of dynamically adjusting the spacing between the top and bottom scrim roll of the scrim roll sets based upon the determined optimum spacing of each scrim roll set.

7. The method of claim 5, further comprising the step of dynamically adjusting the speed of the top and bottom scrim roll of the scrim roll sets based upon the determined optimum spacing of each scrim roll set.

8. The method of claim 1, further comprising the step of drying the scrim stalk material at a temperature range of 180° to 280° F., wherein the residual moisture content for the scrim stalk material should be in the range of 5% to 20%.

* * * * *